US005646657A

United States Patent [19]

Aoki

[11] Patent Number: 5,646,657

[45] Date of Patent: Jul. 8, 1997

[54] LASER WORKABLE NOZZLE PLATE OF INK JET APPARATUS AND METHOD FOR FORMING THE LASER WORKABLE NOZZLE PLATE

[75] Inventor: Hikoharu Aoki, Nagoya, Japan

[73] Assignee: Brother Kogyo Kabushiki Kaisha, Nogoya, Japan

[21] Appl. No.: 392,510

[22] Filed: Feb. 23, 1995

[30] Foreign Application Priority Data

May 16, 1994 [JP] Japan ..... 6-100835

[51] Int. Cl.[6] ..... B41J 2/135; B41J 2/16

[52] U.S. Cl. ..... 347/45; 216/47

[58] Field of Search ..... 216/47; 347/45

[56] References Cited

U.S. PATENT DOCUMENTS

| | | | |
|---|---|---|---|
| 3,946,398 | 3/1976 | Kyser et al. . | |
| 4,723,129 | 2/1988 | Endo et al. . | |
| 4,879,568 | 11/1989 | Bartky et al. . | |
| 4,887,100 | 12/1989 | Michaelis et al. . | |
| 5,016,028 | 5/1991 | Temple . | |
| 5,208,604 | 5/1993 | Watanabe et al. . | |
| 5,365,255 | 11/1994 | Inoue et al. | 347/45 |
| 5,451,992 | 9/1995 | Shimomura et al. | 347/45 |

FOREIGN PATENT DOCUMENTS

| | | |
|---|---|---|
| 53-12138 | 4/1978 | Japan . |
| 61-59914 | 12/1986 | Japan . |
| 63-247051 | 10/1988 | Japan . |
| 2-150355 | 6/1990 | Japan . |
| 6-6375 | 1/1994 | Japan . |

OTHER PUBLICATIONS

"Ultraviolet Laser Ablation of Organic Polymers", R. Srinivasan et al., Chem. Rev. 1989, 89, pp. 1303–1316.

*Primary Examiner*—Valerie Lund

*Attorney, Agent, or Firm*—Oliff & Berridge

[57] ABSTRACT

A nozzle plate has a repellent film formed on or over a nozzle sheet. The repellent film is made by adding an emulsion polymer ultraviolet ray absorbent agent to a fluorine-based polymer. In this nozzle plate, an out-of-roundness of a nozzle formed on the repellent film side of the nozzle plate is smaller, so that variations in the propulsion direction of the ejected ink drops are reduce. Particularly, when the weight percentage of the emulsion polymer ultraviolet ray absorbent agent exceeds 20%, the shape of the nozzle hole formed on the water and oil repellent film side of the nozzle plate has a roundness of 2 μm or less. Accordingly, few variations in the propulsion direction of the ejected ink drops occur, providing superior print quality.

20 Claims, 3 Drawing Sheets

LASER WORKABLE NOZZLE PLATE OF INK JET APPARATUS AND METHOD FOR FORMING THE LASER WORKABLE NOZZLE PLATE

BACKGROUND OF THE INVENTION

1. Field of the Invention

This invention relates to a nozzle plate of an ink jet apparatus. In particular, this invention relates to a method for forming higher quality nozzle apertures on the nozzle plate and a nozzle plate structure permitting the forming of higher quality nozzle apertures.

2. Description of Related Art

U.S. Pat. No. 5,208,604 discloses a conventional fabrication method for forming nozzles in a nozzle plate of an ink jet apparatus. A nozzle plate, forming part of an ink jet head for ejecting ink, has a plurality of nozzles through which the ink is ejected. The nozzle plate is formed from a polymeric material such as polyimide polyethersulfone. The nozzles are formed by exposing the nozzle plate to an excimer laser beam using a mask having transparent portions corresponding to areas of the nozzle plate in which the nozzles are to be formed. When exposed to the excimer laser beam, the exposed portions of nozzle plate absorb the excimer laser beam, thus separating a molecular bond in the polyimide polyethersulfone. The polyimide polyethersulfone molecules and the atoms freed from their bonds decompose and spread to make nozzle apertures, as described in "Ultraviolet Laser Ablation of Organic Polymers", *Chemical Reviews*, Vol. 89, No. 6, pages 1303–1316, 1989.

In this fabrication method, an inner diameter of the nozzle on an excimer laser entrance side of the nozzle plate is larger than an inner diameter of the nozzle on an excimer laser exit side of the nozzle plate. Preferably, the inner diameter of the nozzle on an ink jet side should be smaller than the inner diameter of the nozzle on the inside of the ink jet head. For this reason, the surface of the nozzle plate on the inside of the head is exposed to the excimer laser beam.

However, this conventional nozzle fabrication method, as disclosed in U.S. Pat. No. 5,208,604, encounters a problem that laser workability is considerably deteriorated when a fluorine-based or silicon-based repellent film is applied to the ink jet side of the nozzle plate to improving the ink ejection property of the nozzle. The repellent film repels water and oil, and is used when the nozzle plate is formed from, for example, polyimide polyethersulfone.

The fluorine-based or silicon-based repellent film does not absorb the ultra-violet wavelength radiation generated by excimer lasers. For example, a krypton-fluorine (KrF) laser emits at a wavelength of 248 nm, while a xenon-krypton (XeKr) laser emits at 308 nm. Hence, the repellent film is not processed by the excimer laser. Rather, the repellant film is processed only by the heat and kinetic energy resulting from the decomposition and spread of molecules and atoms of the plate. As previously mentioned, in terms of the shape of the nozzle, the inner diameter of the nozzle on the ink ejection side should be smaller than the inner diameter of the nozzles on the inside of the ink jet head. For this reason, a surface of the nozzle plate, which is opposite to the surface on which the repellent film is formed, is exposed to the excimer laser. Since the heat and kinetic energy resulting from the decomposition and spread of molecules and atoms of the nozzle plate and transmitted to the repellent film is small, the repellent film is not suitably processed. Thus, the geometrical and dimensional accuracy of the nozzle deteriorates by two or three times relative to the required accuracy. When the heat and kinetic energy resulting from the decomposition and spread of molecules and atoms of the nozzle plate is small and the distribution of the energy varies, the shape of apertures formed on the ink ejection side is degraded. As a result, the direction in which the ink drops are propelled as they are ejected varies, resulting in poor print quality.

SUMMARY OF THE INVENTION

This invention provides a nozzle plate for an ink jet head of an ink jet apparatus that has superior dimensional accuracy and prevents variations in the propulsion direction of the ink drops.

This invention further provides a nozzle plate for an ink jet head of an ink jet apparatus comprising a substrate made of material which absorbs an excimer laser beam, and an excimer-laser-processable repellent film. The excimer-laser-processable repellant film is formed made by mixing a water and oil repellent material, which does not absorb the excimer laser beam, with an ultraviolet ray absorbent agent which absorbs the excimer laser beam. Accordingly, the nozzles can be formed by exposing the substrate to the excimer laser after the excimer-laser-processable repellent film has been formed over the substrate. The ultraviolet ray absorbent agent is an emulsion polymer ultraviolet ray absorbent material. The water and oil repellent material is a fluorine-based or silicon-based material. The excimer-laser-processable repellent film preferably contains not less than 20 percent but not more than 60 percent of the ultraviolet ray absorbent agent.

In the nozzle plate of the ink jet apparatus of this invention, the excimer-laser-processable repellent film is suitably processed by exposure to the excimer laser beam. As a result, nozzles having a suitable shape are formed. This result is obtained because the molecules and atoms of the ultraviolet ray absorbent agent of the excimer-laser-processable repellent film decompose and spread within the excimer-laser-processable repellent film from exposure to the excimer laser beam.

Thus, in this invention, the excimer-laser-processable repellent film, which is formed over the surface of the substrate, and which absorbs the excimer laser beam, is formed by mixing a water and oil repellent material, which does not absorb the excimer laser beam, with a ultraviolet ray absorbent agent, which absorbs the excimer laser beam. Accordingly, the resulting excimer-laser-processable repellent film is formed over the ink ejection side of the nozzle plate, and is well processed when nozzles are formed by irradiation of the nozzle plate by the excimer laser beam. Accordingly, the dimensional accuracy of processed nozzles is improved, and variations in the propulsion direction of the ink drops are prevented. Thus, the ink jet apparatus employing this nozzle plate provides superior print quality.

BRIEF DESCRIPTION OF THE DRAWINGS

A preferred embodiment of the present invention will be described in detail with reference to the following figures, wherein.

DETAILED DESCRIPTION OF THE PREFERRED EMBODIMENT

Figure 1:
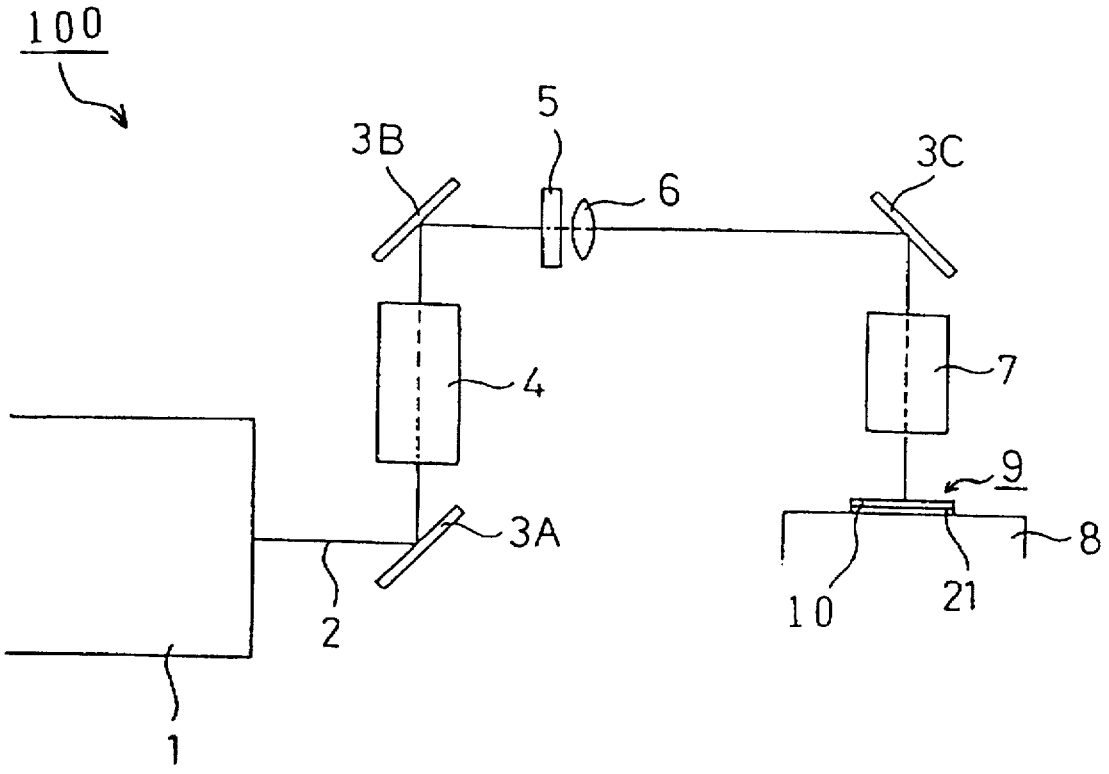
FIG. 1 shows a preferred embodiment of a nozzle processing machine according to this invention.

FIG. 1 shows a laser nozzle processing machine 100. The nozzle processing machine 100 has a laser oscillator 1 which emits an excimer laser beam 2. In general, any ultraviolet radiation source, such as an ultraviolet-emitting fluorescent or incandescent light bulb, can be used in place of the excimer laser beam 2. However, the ultraviolet excimer laser beam 2 is preferred.

The excimer laser beam 2 emitted from the laser oscillator I travels to a work table 8 along an optical path defined by mirrors 3A, 3B, and 3C. A beam expander 4 is provided in the optical path between the mirror 3A and the mirror 3B and expands the diameter of the excimer laser beam 2 to a desired size. A mask 5 is provided in the optical path between the mirror 3B and the mirror 3C and masks the excimer laser beam 2 into a desired image. That is, by passing the excimer laser beam 2 through the mask 5, a mask image is created and projected in the direction of travel of the excimer laser beam 2. A field lens 6 is provided downstream of and adjacent to the mask 5 and guides the excimer laser beam 2 having the mask image to an imaging optical system 7. The imaging optical system 7 is positioned between the mirror 3C and the work table 8 and focuses the excimer laser beam 2 having the mask image onto a nozzle plate 9 to be processed, which is positioned on the work table 8. The nozzle plate 9 comprises a nozzle sheet 10 and the excimer-laser-processable repellant film 21.

The mask 5 and the imaging optical system 7 are set in accordance with the desired shape of the nozzles and the desired laser processing conditions. The excimer laser beam 2 used in this embodiment is a krypton-fluorine (KrF) excimer laser beam having a wavelength of 248 nm.

A liquid mixture is formed by dissolving an emulsion polymer ultraviolet ray absorbent agent into a fluorine-based polymer, for example tetrafluoroethylene-hexafluoropropylene. A benzophenol-based emulsion polymer (preferably, UVA-383MG produced by BASF Japan) is used as the emulsion polymer ultraviolet ray absorbent agent. The fluorine-based polymer is a water and oil repellent material. The liquid mixture is applied to one side of the nozzle sheet 10 to form the excimer-laser-processable repellent film 21. The nozzle sheet 10 is formed of polyimide. The surface of the nozzle plate 9 is exposed to the excimer laser 2, thus forming the ink jet nozzles in the nozzle plate.

The nozzle plate 9, which is subjected to this nozzle processing, is attached to an ejector head (not shown), so that an ink jet head is produced. The possible ejection methods used by the ink jet head include a Kyser type ejection method disclosed in Japanese Patent Publication No. 53-12138, a thermal jet ejection method disclosed in Examined Japanese Patent Publication No. 61-59914, and a shear mode ejection method disclosed in Japanese Laid-Open Patent Publication Nos. 63-247051, 63-252750, and 2-150355.

Seven versions of the excimer-laser-processable repellent film 21 were prepared, in which the percentage by weight of the emulsion polymer ultraviolet ray absorbent agent in the excimer-laser-processable film 21 was varied 10% intervals between 10% and 70%, inclusively. The various excimer-laser-processable repellent films 21 were formed on nozzle sheets 10. The resulting nozzle plates 9 were processed using the excimer laser beam 2 as described above.

The excimer laser workability of each of the seven different excimer-laser-processable repellent films 21 was evaluated based on the resulting out-of-roundness of the nozzles. The out-of-roundness is the difference between the smallest diameter and the largest diameter of the aperture of the nozzle, when measured in a single plane. The out-of-roundness of the resulting hole or aperture of the nozzle at the ink ejection side (i.e., the repellent film side) was measured. When the out-of-roundness of the resulting aperture is less than 2 μm, the quality of the aperture is excellent.

Figure 2:
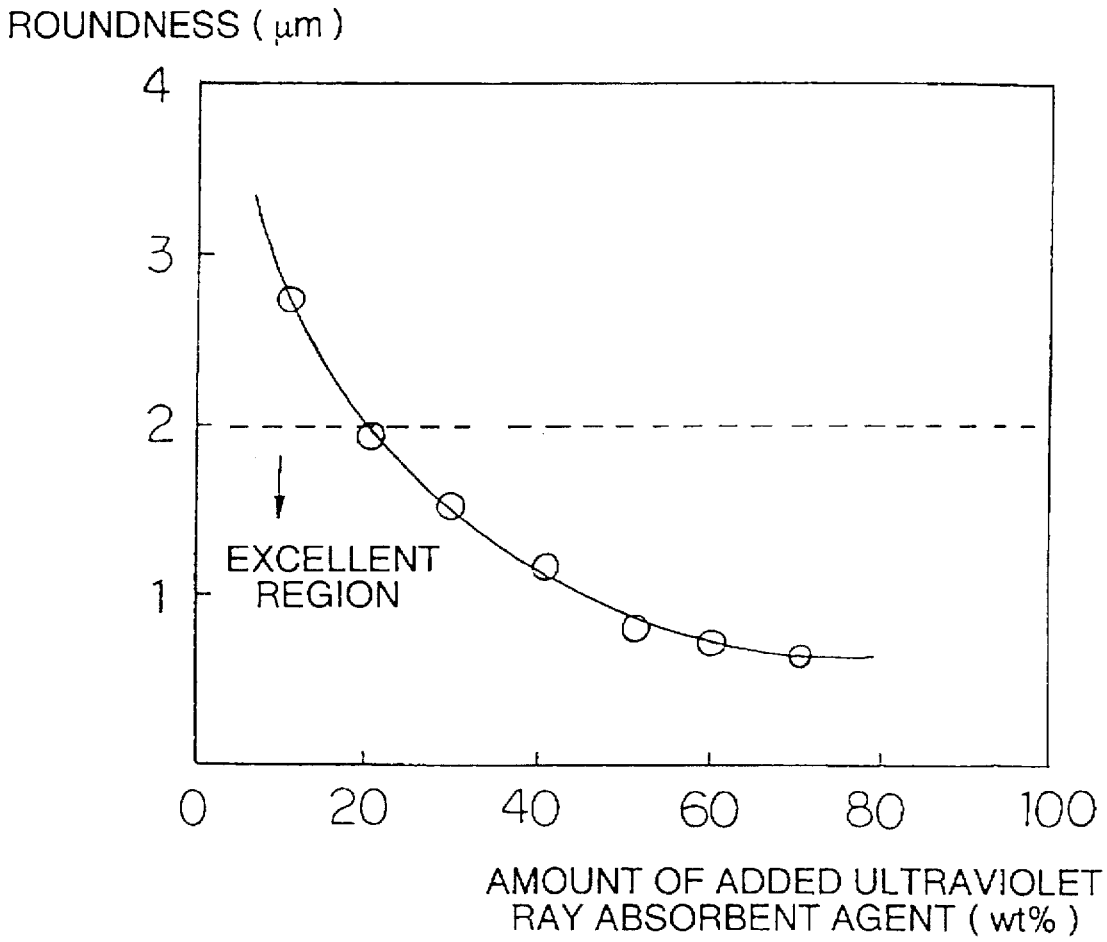
FIG. 2 is a graph showing laser workability of the nozzle processing system in the preferred embodiment relative to the amount of added ultraviolet ray absorbent agent.

FIG. 2 shows the measurement results for the seven different excimer-laser-processable repellent films 21. When the percentage of the emulsion polymer ultraviolet ray absorbent added to the water and oil repellent material to form the repellent film increases from 10% to 70% as shown in FIG. 2, the out-of-roundness decreases. It was ascertained that the out-of-roundness of the nozzle hole formed on the repellent film side of the nozzle plate 9 was reduced to at most 2 μm when the weight percentage of the emulsion polymer ultraviolet ray absorbent agent in the fluid mixture was at least 20% and the percentage of the water and oil repellant material was at most 80%.

As the out-of-roundness was reduced, variations in the propulsion direction of the ejected ink drops were also reduced. When the out-of-roundness was reduced to at most 2 μm, no substantial variations occurred in the propulsion direction of the ejected ink drops, thereby resulting in superior print quality.

As mentioned above, when forming the nozzle plate 9 according to this invention, the repellent film 21 is formed by applying the fluid mixture, formed by dissolving the emulsion polymer ultraviolet ray absorbent agent into the fluorine-based polymer (tetrafluoroethylene-hexafluoropropylene), to one side of the nozzle sheet 10. Nozzle processing using the excimer laser 2 is performed, resulting both in nozzles having an improved dimensional accuracy and in the prevention of variations in the propulsion direction of the ejected ink drops. Therefore, superior print quality is obtained by the ink jet head using this nozzle plate 9.

Particularly, when the weight percentage of the emulsion polymer ultraviolet ray absorbent agent in the fluid mixture is at least 20%, few variations occur in the propulsion direction of the ejected ink drops. Moreover, when the weight percentage of the emulsion polymer ultraviolet ray absorbent agent in the fluid mixture is at most 60% (and thus the percentage of the water and oil repellant material is at least 40%), the nozzle sheet 10 is not wetted by the repellent film 21. Therefore, superior printing can be effected. That is, when the weight percentage of the emulsion polymer ultraviolet ray absorbent agent in the fluid mixture is 70%, the water repellency of the repellent film 21 deteriorates, and the nozzle sheet 10 becomes wetted. This adversely affects printing. Accordingly, if the weight percentage of the emulsion polymer ultraviolet ray absorbent agent in the fluid mixture is between 20% and 60%, inclusively, it is possible to form a nozzle plate 9 that has superior water repellant properties and that provides nozzles having superior dimensional accuracy. In particular, when the weight percentage of the emulsion polymer ultraviolet ray absorbent agent is 50%, the best combination of water repellant properties and dimensional accuracy for the nozzle plate 9 was obtained. This makes it possible to realize superior printing.

Figure 3:
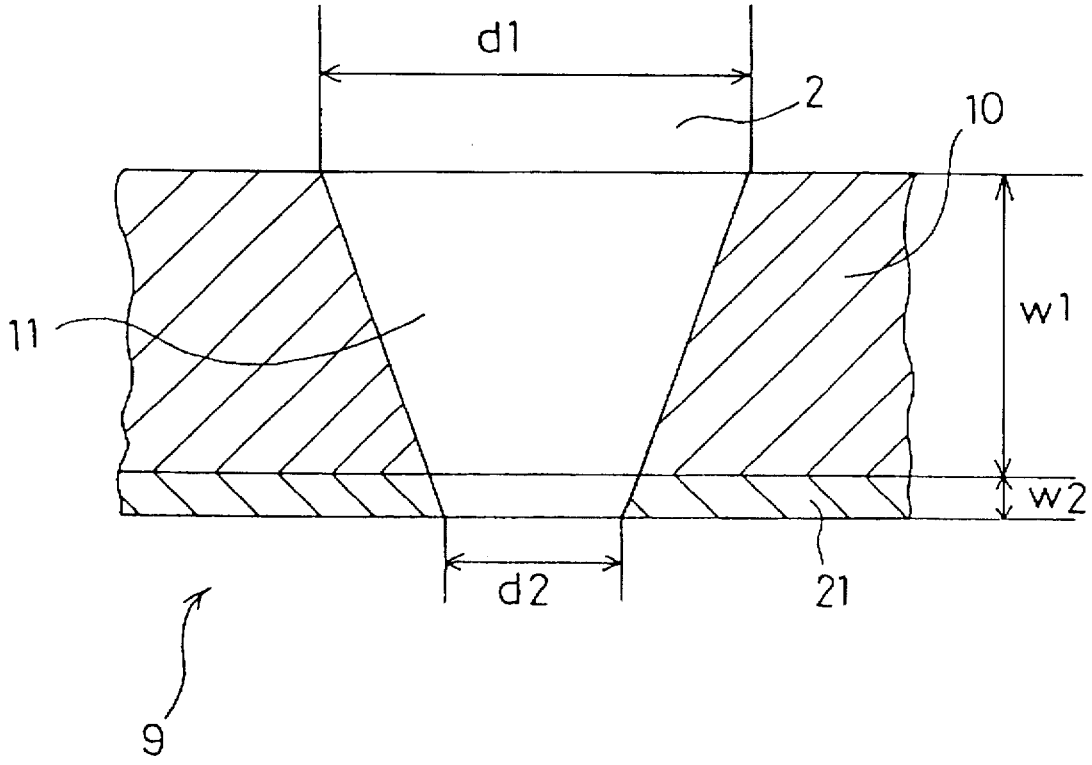
FIG. 3 is a sectional view of a nozzle plate having a nozzle formed therein.

FIG. 3 shows a sectional view of the nozzle plate 9 with a nozzle 11. As shown in FIG. 3, the excimer laser beam 2 has a diameter d1. The nozzle plate 9 has a nozzle sheet 10 having a thickness of w1 and a repellant film 21 having a thickness of w2. The nozzle 11 has an ink-head-side aperture having a diameter d1 in the nozzle sheet 10, while the ink-jet-side aperture has a diameter of d2 formed in the repellant film 21. In forming the nozzles 11 in the nozzle plate 9, the nozzle plate 9 is exposed for an exposure time period t. In an experimental example of the nozzle plate 9 having the repellant film 21 having a 50% by weight of the emulsion polymer ultraviolet ray absorbent agent, the nozzle sheet width w1 is preferably 125 μm, the repellant film width w2 is preferably 1 μm, the excimer laser beam diameter and ink-head-side aperture diameter d1 is preferably 70 μm, the ink-jet-side aperture diameter d2 is preferably 40 μm, and the exposure time t is preferably 3 seconds. However, it should be appreciated that these values for d1, d2, w1, w2, and t are exemplary only, and any appropriate values for these variables is allowable.

Although polyimide is used for the nozzle sheet 10 in the embodiment, any materials, such as polyethersulfone, are usable so long as they absorb the excimer laser beam 2.

Tetrafluoroethylene-hexafluoropropylene is the fluorine-based polymer used as the water and oil repellent material. Alternatively, tetrafluoroethylene or vinyliden fluoride or the like may be used as the water and oil repellant material. Further, a silicon oil or the like may be used as the water and oil repellent material.

In the preferred embodiment, the surface of the nozzle plate 9 is exposed to the excimer laser beam 2, and the nozzle sheet 10 and the repellent film 21 are processed. However, it may be possible to expose the surface of the nozzle sheet 10 which is coated with the repellent film 21 to the excimer laser beam 2 to process the nozzle sheet 10 and the repellent film 21. In this case, if the nozzle plate 9 is exposed to the excimer laser beam 2 while being swayed, it will become possible to make the size of apertures formed on the nozzle sheet side of the nozzle plate 9 larger than the size of apertures formed on the repellent film side of the nozzle plate 9.

The method according to this invention is described assuming that during processing of the nozzle plate 9, the mask 5 is kept apart from the nozzle plate 9 as it is processed. However, a contact method is also usable in which the nozzle plate 9 is processed while the 5 mask is in contact with it.

While this invention has been described with reference to a preferred embodiment, this description is not intended to be construed in a limiting sense. Various modifications of the preferred embodiment, as well as other embodiments of the invention, will be apparent to those versed in the art upon reference to this description. It is, therefore, contemplated that the appended claims will cover any such modifications or embodiments as fall within the true scope of the invention.

What is claimed is:

1. A nozzle plate having nozzles and comprising:

a substrate formed of material which absorbs an excimer laser beam; and a repellent film formed over a surface of the substrate, wherein the repellent film comprises:

a water and oil repellent material which does not absorb the excimer laser beam, and an ultraviolet ray absorbent agent which absorbs the excimer laser beam;

wherein the nozzles are formed by exposing the nozzle plate to the excimer laser beam after the repellent film has been formed over the substrate.

2. The nozzle plate of claim 1, wherein the ultraviolet ray absorbent agent is an emulsion polymer ultraviolet ray absorbent material.

3. The nozzle plate of claim 1, wherein the water and oil repellent material is one of a fluorine-based or silicon-based material.

4. The nozzle plate of claim 1, wherein the repellent film comprises at least 20 percent of the ultraviolet ray absorbent agent by weight.

5. The nozzle plate of claim 4, wherein the repellent film comprises at most 60 percent of the ultraviolet ray absorbent agent by weight.

6. The nozzle plate of claim 5, wherein the repellent film comprises 50 percent of the ultraviolet ray absorbent agent by weight.

7. The nozzle plate of claim 1, wherein the repellent film comprises at most 60 percent of the ultraviolet ray absorbent agent by weight.

8. The nozzle plate of claim 1, wherein the nozzle plate is provided in an ink jet apparatus, the ink jet apparatus forming images by ejecting ink from the nozzles.

9. The nozzle plate of claim 8, wherein the ink jet apparatus is one of a Kyser-type ink jet apparatus, a thermal-type ink jet apparatus, and a shear-mode-type in jet apparatus.

10. The nozzle plate of claim 1, wherein the repellant film is formed on the surface of the substrate.

11. The nozzle plate of claim 1, wherein the substrate side of the nozzle plate is exposed to the excimer laser beam.

12. A nozzle plate having nozzles and comprising:

a substrate formed of material which absorbs ultraviolet radiation; and a repellent film formed over a surface of the substrate, wherein the repellent film comprises:

a water and oil repellent material which does not absorb ultraviolet radiation, and an ultraviolet radiation absorbent agent which absorbs ultraviolet radiation;

wherein the nozzles are formed by exposing the nozzle plate to ultraviolet radiation after the repellent film has been formed over the substrate.

13. The nozzle plate of claim 12, wherein the ultraviolet radiation is an ultraviolet excimer laser beam emitted by an excimer laser.

14. The nozzle plate of claim 12, wherein the nozzle plate is provided in an ink jet apparatus, the ink jet apparatus forming images by ejecting ink from the nozzles.

15. A method for forming nozzles in a nozzle plate, comprising:

mixing an ultraviolet ray absorbent agent which absorbs an excimer laser beam and a water and oil repellant material which does not absorb the excimer laser beam to form a mixture;

providing a repellant film of the mixture over a surface of a substrate formed of a material which absorbs the excimer laser beam to form the nozzle plate; and exposing the nozzle plate to the excimer laser beam to form the nozzles.

16. The method of claim 15, wherein the mixing step comprises adding sufficient ultraviolet ray absorbent agent to comprise at least 20% by weight of the mixture.

17. The method of claim 15, wherein the mixing step comprises adding sufficient water and oil repellant material to comprise at least 40% by weight of the mixture.

18. The method of claim 15, wherein the exposing step comprises exposing a substrate side of the nozzle plate to the excimer laser beam.

19. The method of claim 15, wherein the exposing step comprises passing the excimer laser beam through a mask.

20. The method of claim 19, wherein the exposing step further comprises positioning the mask a distance from the nozzle plate.

* * * * *